US008080989B2

(12) United States Patent
Jo

(10) Patent No.: US 8,080,989 B2
(45) Date of Patent: Dec. 20, 2011

(54) BANDGAP REFERENCE VOLTAGE GENERATING CIRCUIT FOR OBTAINING STABLE OUTPUT VOLTAGE IN SHORT TIME BY PERFORMING STABLE START-UP WHEN SWITCHED FROM SLEEP MODE TO OPERATION MODE

(75) Inventor: Eun-Sang Jo, Gangnam-gu (KR)

(73) Assignee: Dongbu HiTek Co., Ltd., Seoul (KR)

( * ) Notice: Subject to any disclaimer, the term of this patent is extended or adjusted under 35 U.S.C. 154(b) by 500 days.

(21) Appl. No.: 12/344,374

(22) Filed: Dec. 26, 2008

(65) Prior Publication Data

US 2009/0167281 A1 Jul. 2, 2009

(30) Foreign Application Priority Data

Dec. 26, 2007 (KR) ..... 10-2007-0137125

(51) Int. Cl.
*G05F 3/16* (2006.01)
*G05F 3/20* (2006.01)

(52) U.S. Cl. ..... 323/313; 323/316

(58) Field of Classification Search ..... 323/313, 323/316, 901

See application file for complete search history.

(56) References Cited

U.S. PATENT DOCUMENTS

| | | | | |
|---|---|---|---|---|
| 4,857,823 | A * | 8/1989 | Bitting | 323/314 |
| 5,610,506 | A * | 3/1997 | McIntyre | 323/313 |
| 5,629,611 | A * | 5/1997 | McIntyre | 323/313 |
| 6,018,235 | A * | 1/2000 | Mikuni | 323/313 |
| 6,677,808 | B1 * | 1/2004 | Sean et al. | 327/539 |
| 2008/0231248 | A1 * | 9/2008 | Hung | 323/313 |

* cited by examiner

*Primary Examiner* — Jessica Han
*Assistant Examiner* — Gary Nash
(74) *Attorney, Agent, or Firm* — Sherr & Vaughn, PLLC

(57) ABSTRACT

A bandgap reference voltage generating circuit, includes: at least two bipolar transistors; an operational amplifier; a first PMOS transistor; and a second PMOS transistor whose source is connected to the upper limit power supply voltage and which supplies the reference current to the bipolar transistors. Further, the bandgap reference voltage generating circuit includes a third PMOS transistor whose source is connected to the upper limit power supply voltage; a fourth PMOS transistor whose source is connected to the upper limit power supply voltage and gate is connected to a drain of the third PMOS transistor; a first NMOS transistor whose source is connected to the lower limit power supply voltage and drain is connected to a drain of the fourth PMOS transistor; and a second NMOS transistor whose drain is connected to the operational amplifier and gate is connected to the drain of the first NMOS transistor.

19 Claims, 4 Drawing Sheets

BANDGAP REFERENCE VOLTAGE GENERATING CIRCUIT FOR OBTAINING STABLE OUTPUT VOLTAGE IN SHORT TIME BY PERFORMING STABLE START-UP WHEN SWITCHED FROM SLEEP MODE TO OPERATION MODE

The present application claims priority under 35 U.S.C. 119 to Korean Patent Application No. 10-2007-137125 (filed on Dec. 26, 2007), which is hereby incorporated by reference in its entirety.

BACKGROUND

In a semiconductor integrated circuit, the reliability of the entire system is improved by stably maintaining the internal biasing reference voltage. That is, even if an external power supply voltage, temperature, or a process is changed, the devices in the integrated circuit should function without being affected by the change in the external power supply voltage, temperature, or process. For this purpose, reference voltage generating circuits which are designed to supply a stable and constant reference voltage are provided. However, these reference voltage generating circuits may be made unstable due to a change in temperature, process conditions, and an external supply voltage.

Among the reference voltage generating circuits, a bandgap reference voltage generating circuit is a circuit which outputs a constant voltage regardless of a change in temperature, supply voltage, or process. Such a reference voltage generating circuit adds a voltage proportional to an absolute temperature generated by a PTAT (Proportional To Absolute Temperature) circuit and a voltage at a base-emitter junction having a negative temperature coefficient, thereby outputting a stable reference voltage, regardless of the change in temperature.

This related reference voltage generating circuit outputs a stable reference voltage when two input transistors in an operational amplifier are implemented to have the same size. The related bandgap reference voltage generating circuit includes a temperature compensating circuit having a bipolar transistor and a resistor, an operational amplifier OP AMP that stably outputs a bias reference current, a feedback circuit, and a start-up circuit that enables the start-up of the entire circuit when a voltage is supplied and when a sleep mode is switched over to an operation mode.

In detail, as shown in FIG. 1, the related bandgap reference voltage generating circuit includes an operational amplifier 10 that outputs a constant voltage according to a reference voltage input to an inversion terminal and a non-inversion terminal, bipolar transistors Q1 and Q2 whose collectors are connected to a power supply voltage AVSS3 at a minimum potential level, resistors R1, R2, and R3 that are connected to the emitters of the bipolar transistors Q1 and Q2 and the input terminals of the operational amplifier 10, PMOS transistor MP1 and MP2 that supply a reference current to the bipolar transistors Q1 and Q2, and a start-up circuit 100 that enables the bandgap reference voltage generating circuit to set a stable operation point when the sleep mode is switched over to the operation mode or when the operation mode is switched over to the sleep mode. The bandgap reference voltage generating circuit generates a reference voltage by using a difference in the emitter-base voltage between the two bipolar transistors Q1 and Q2.

The start-up circuit 100 has three PMOS transistors MP3, MP4, and MP5, and four NMOS transistors MN1, MN2, MN3, and MN4. FIG. 2 shows the output characteristic of the related bandgap reference voltage generating circuit. Referring to FIG. 2, when the process mismatch between the input terminals of the operational amplifier 10 is 0.11% (1.1 mV) or more, a voltage required when the sleep mode is switched over to the operation mode does not rise to DC 1.0V or more and abnormally stops at 0.4V. That is, in FIG. 2, when the process mismatch between the input transistors of the operational amplifier 10 is 0%, a stable bandgap characteristic is shown (for example, an output A). Meanwhile, when the process mismatch between the input transistors of the operational amplifier 10 is 0.11% or more, an abnormal characteristic is shown (for example, an output B).

As such, in the related reference voltage generating circuit, when the mismatch between the two input transistors of the operational amplifier is 0.11% or more, the reference voltage of 0.4 V is output. For this reason, the reference voltage circuit is undesirable. In the related bandgap circuit, when the start-up circuit is in the sleep mode, the operational amplifier is put in a high state. Then, when the sleep mode is switched over to the operation mode, when the mismatch between the input transistors of the operational amplifier is beyond the tolerance or when the start-up circuit does not normally operate, the output voltage of the bandgap circuit may not be set and put in a high state.

Therefore, the related reference voltage generating circuit has a problem in that when the sleep mode is switched over to the operation mode, the operational amplifier does not have a stable operation point due to a slow operation time caused by the start-up circuit.

SUMMARY

According to embodiments, a bandgap reference voltage generating circuit is provided that, when a sleep mode is switched over to an operation mode, can stably operate, thereby generating a constant bandgap reference voltage. Stable operation occurs regardless of an erroneous operation of a start-up circuit or a change in the device due to process mismatch.

According to embodiments, a bandgap reference voltage generating circuit may include at least one of the following: at least two bipolar transistors whose collectors are connected to a lower limit power supply voltage and which generate a reference voltage by using a difference in emitter-base voltage; an operational amplifier which outputs a constant voltage according to the reference voltage and an inverted reference voltage from the bipolar transistors; a first PMOS transistor whose source is connected to an upper limit power supply voltage and which supplies a reference current to the bipolar transistors; a second PMOS transistor whose source is connected to the upper limit power supply voltage and which supplies the reference current to the bipolar transistors, the second PMOS transistor being turned on when the bandgap reference voltage generating circuit is in a sleep mode, such that the output of the operational amplifier is charged to a first set value and the first PMOS transistor is turned off; a third PMOS transistor whose source is connected to the upper limit power supply voltage; a fourth PMOS transistor whose source is connected to the upper limit power supply voltage and gate is connected to a drain of the third PMOS transistor, the fourth PMOS transistor being turned on when the bandgap reference voltage generating circuit is switched over from the sleep mode to the operation mode; a first NMOS transistor whose source is connected to the lower limit power supply voltage and drain is connected to a drain of the fourth PMOS transistor, the first NMOS transistor being turned on when the fourth PMOS transistor is turned on, such that the drain voltage thereof is charged to the first set value; and a second NMOS transistor whose drain is connected to the operational amplifier and gate is connected to the drain of the first NMOS transistor, the second NMOS transistor being turned on when the drain voltage of the first NMOS transistor is charged, such that the output of the operational amplifier is discharged from the first set value to a second set value.

According to embodiments, when the bandgap reference voltage generating circuit is switched over from the sleep mode to the operation mode, stable start-up can be performed, and thus a stable output voltage can be obtained in a short time. In addition, even if the process mismatch between the two input transistors of the operational amplifier is 1% or more, a constant bandgap output voltage can be generated, and stability of the bandgap output can be improved. Furthermore, even if the mismatch in resistance between the input terminals of the operational amplifier and the mismatch between the bipolar transistors is 30%, wake-up can be performed in a short time when the bandgap circuit is switched over from the sleep mode to the operation mode.

DRAWINGS

Figure 1:
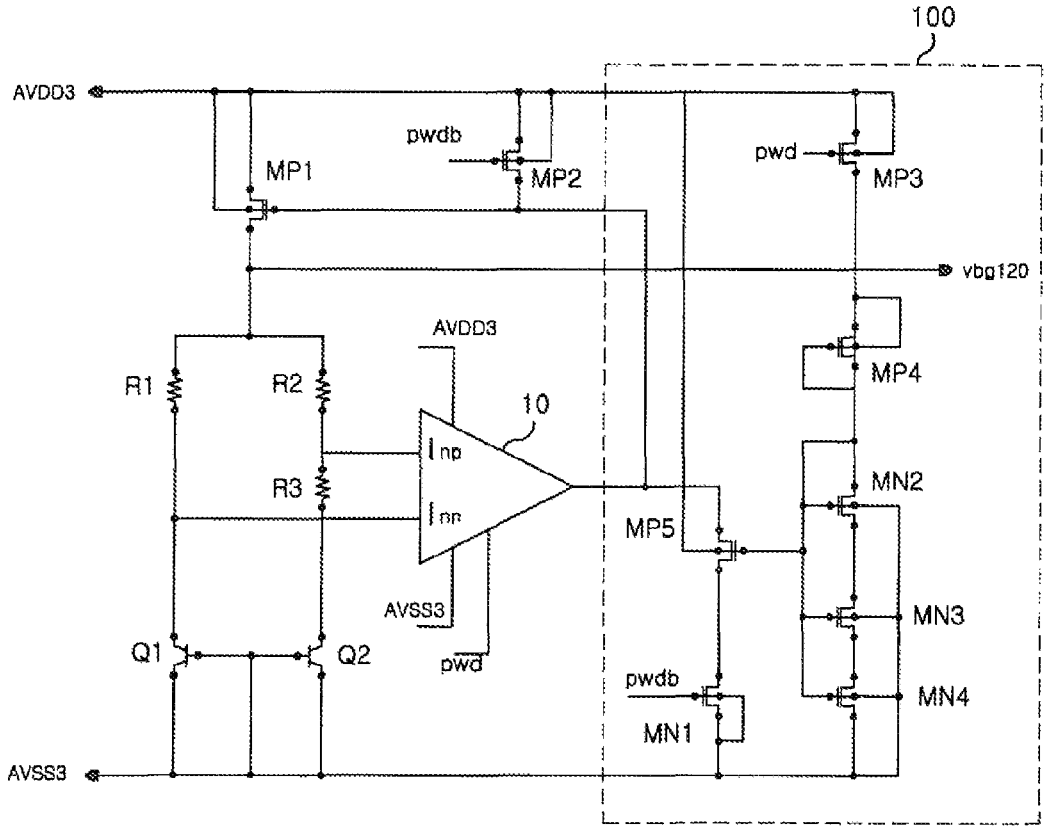
FIG. 1 (PRIOR ART)
FIG. 1 is a circuit diagram of a related bandgap reference voltage generating circuit.
Figure 2:
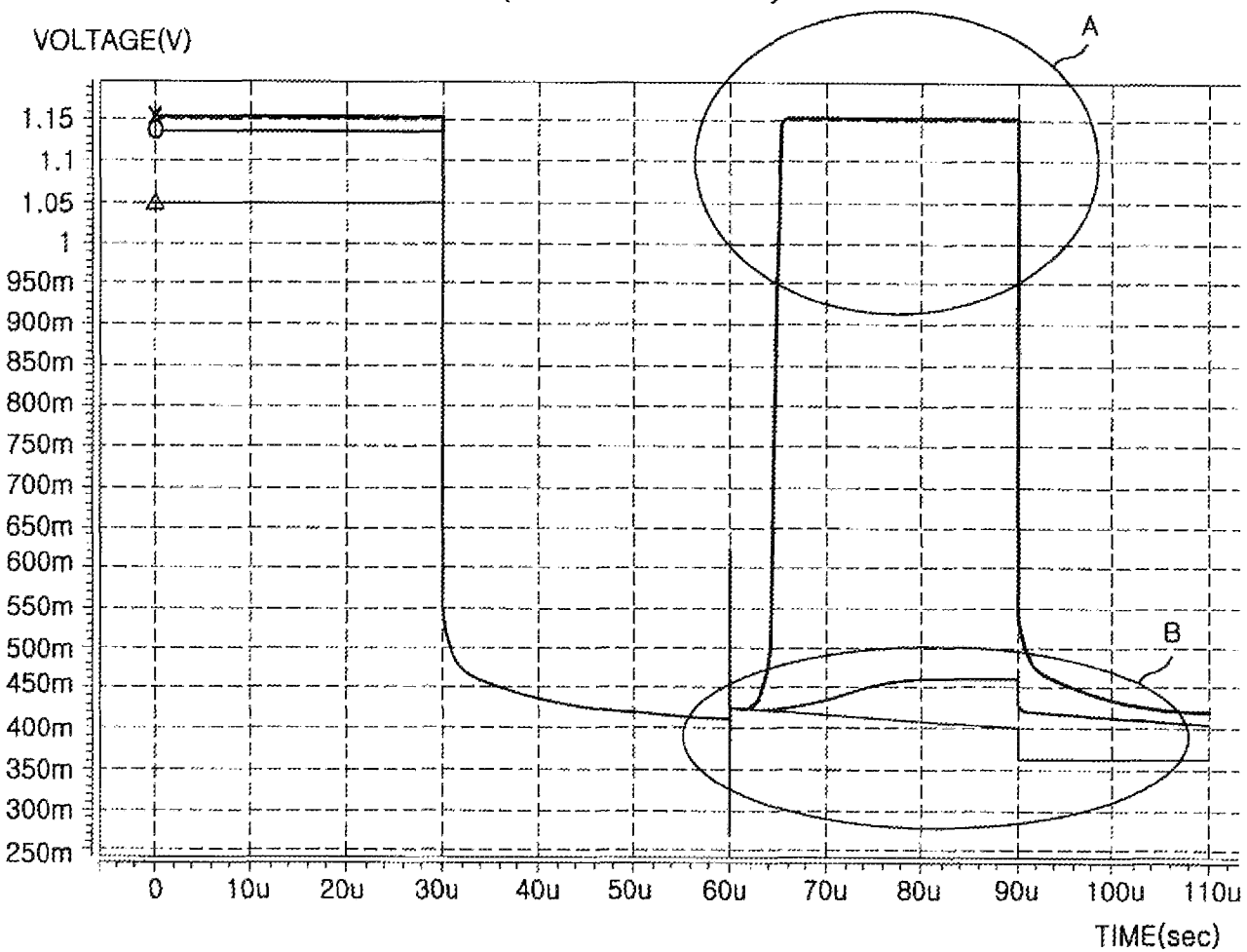
FIG. 2 (PRIOR ART)
FIG. 2 is a graph illustrating an output voltage characteristic of the related bandgap reference voltage generating circuit of FIG. 1.
Figure 3:
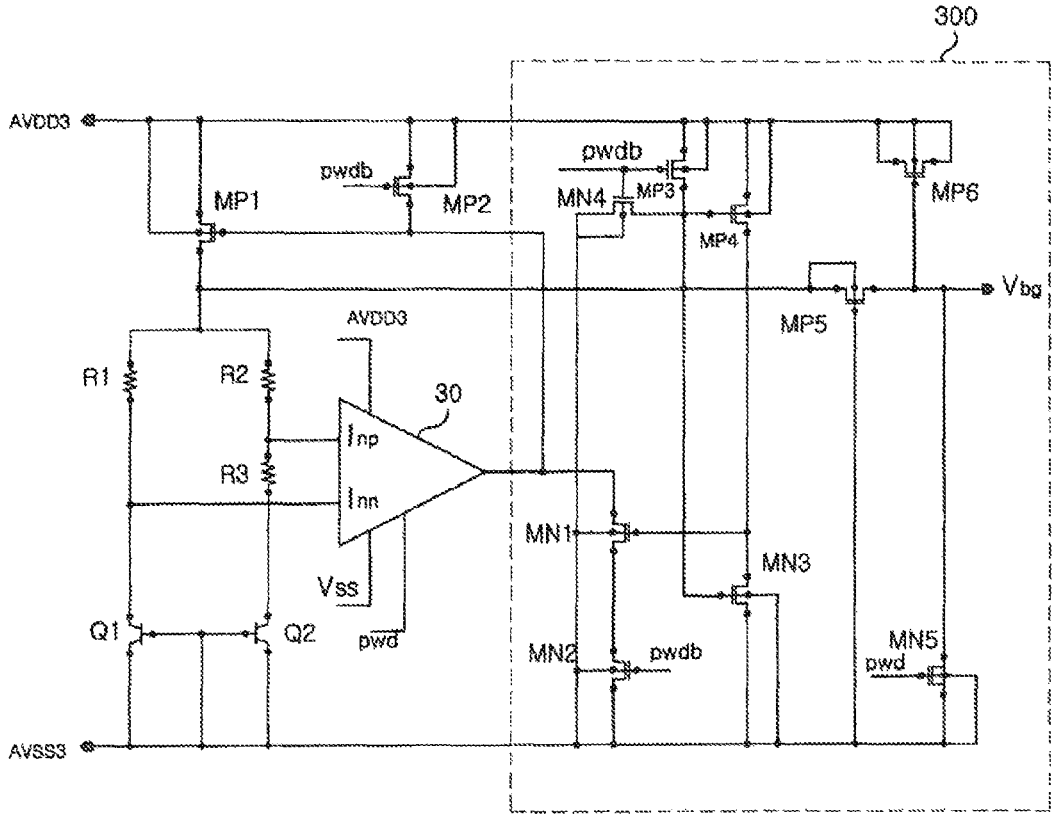

Example FIG. 3 is a circuit diagram of a bandgap reference voltage generating circuit according to embodiments.

Figure 4:
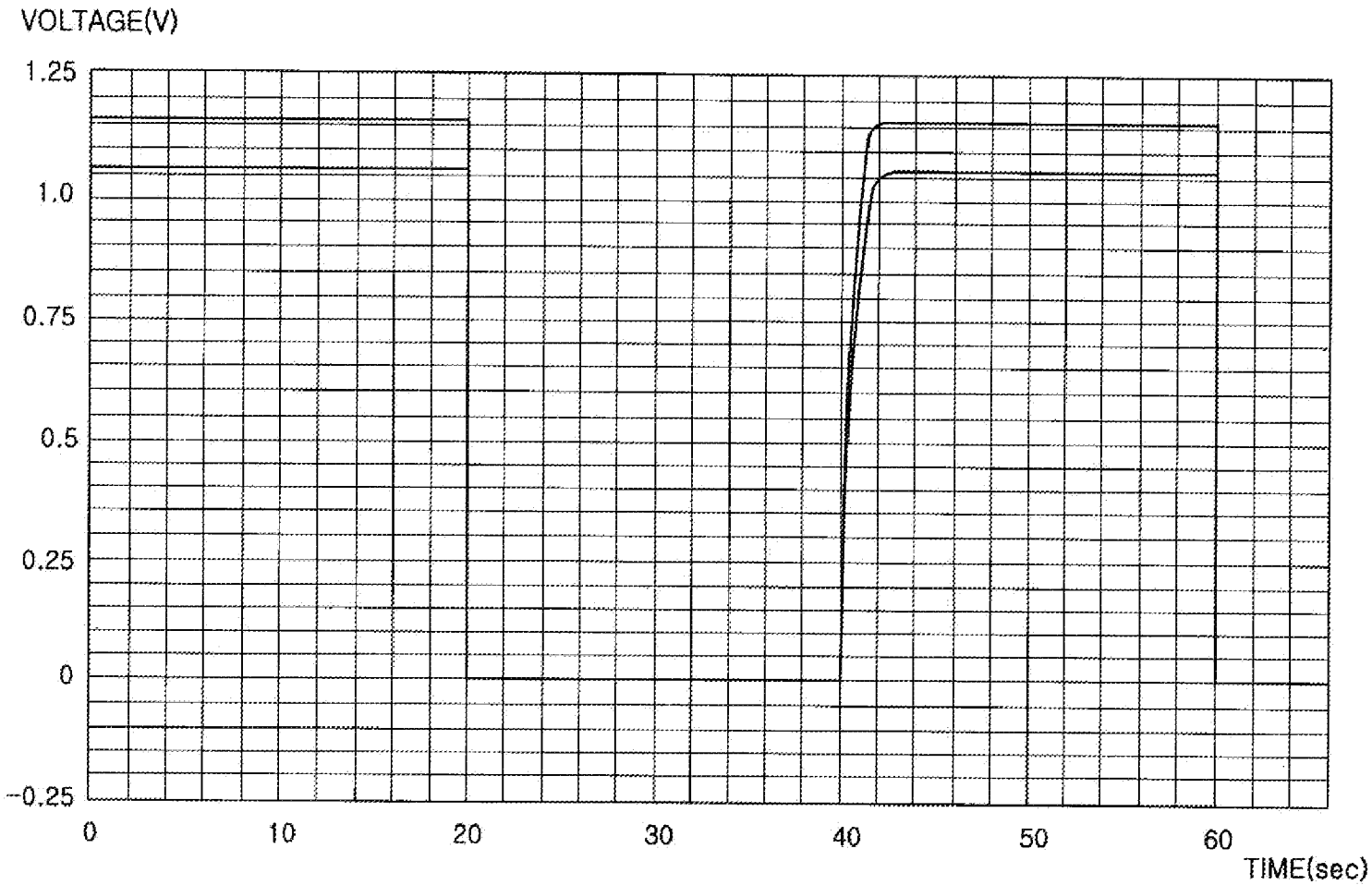

Example FIG. 4 is a graph illustrating an output voltage characteristic of the bandgap reference voltage generating circuit of example FIG. 3.

DESCRIPTION

Example FIG. 3 is a circuit diagram of a bandgap reference voltage generating circuit according to embodiments. The bandgap reference voltage generating circuit may include bipolar transistors Q1 and Q2, resistors R1, R2, and R3, an operational amplifier 30, PMOS transistors MP1, MP2, MP3, MP4, MP5, and MP6, and NMOS transistors MN1, MN2, MN3, MN4, and MN5.

The collectors of the bipolar transistors Q1 and Q2 may be connected to a lower limit power supply voltage AVSS3 at a minimum potential level. A reference voltage may be generated by using a difference in emitter-base voltage between the bipolar transistors Q1 and Q2. The resistors R1, R2, and R3 may be connected to the emitters of the bipolar transistors Q1 and Q2 and the input terminals of the operational amplifier 30. The operational amplifier 30 outputs a constant voltage according to the reference voltage and an inverted reference voltage.

The first and second PMOS transistors MP1 and MP2 whose sources are connected to an upper limit power supply voltage AVDD3 may supply a reference current to the bipolar transistors Q1 and Q2. The second PMOS transistor MP2 may be turned on when the bandgap reference voltage generating circuit is in a sleep mode, such that the output of the operational amplifier 30 is charged to a first set value, for example, about 3.3 V. Such an operation of the second PMOS transistor MP2 may turn off the first PMOS transistor MP1 to cut off a current flowing through the first PMOS transistor MP1.

The third and fourth PMOS transistors MP3 and MP4, and the first to fourth NMOS transistors MN1, MN2, MN3, and MN4 set the output of the operational amplifier 30 to a prescribed value (prescribed operation point) when the sleep mode is switched over to the operation mode or the operation mode is switched over to the sleep mode.

According to embodiments, a source of the third PMOS transistor MP3 may be connected to the upper limit power supply voltage AVDD3 and its drain connected to a gate of the fourth PMOS transistor MP4. The fourth PMOS transistor P4 may have its source connected to the upper limit power supply voltage AVDD3. The fourth PMOS transistor MP4 may be turned on when the bandgap reference voltage generating circuit is switched over from the sleep mode to the operation mode.

A source of the fifth PMOS transistor MP5 may be connected to a drain of the first PMOS transistor MP1, a gate the fifth PMOS transistor MP5 may be connected to the lower limit power supply voltage AVSS3, and its drain may be connected to an output terminal. The fifth PMOS transistor MP5 may function as a low pass filter at the output terminal of the bandgap reference voltage generating circuit so as to remove high-frequency noise.

A source of the sixth PMOS transistor MP6 may be connected to the upper limit power supply voltage AVDD3 while its gate may be connected to the output terminal. Like the fifth PMOS transistor MP5, the sixth PMOS transistor MP6 may function as a low pass filter in the bandgap reference voltage generating circuit, according to embodiments.

A drain of the first NMOS transistor MN1 may be connected to the operational amplifier 30, while its gate may be connected to a drain of the third NMOS transistor MN3. The first NMOS transistor MN1 may be turned on when the drain voltage of the third NMOS transistor MN3 is charged, such that the output of the operational amplifier 30 is discharged from the first set value (for example, about 3.3 V) to a second set value, for example, about 2.1 V.

A drain of the second NMOS transistor MN2 may be connected to a source of the first NMOS transistor MN1, while its source may be connected to the lower limit power supply voltage AVSS3. The second NMOS transistor MN2 may be turned on by a signal such as, for example, sleep mode signal pwdb. In FIG. 3, when signal pwdb is HIGH the second NMOS transistor MN2 may be turned on; however, one of ordinary skill will recognize that the circuit may also be arranged to operate with opposite polarity signals as well.

A source of the third NMOS transistor MN3 may be connected to the lower limit power supply voltage AVSS3, while its drain may be connected to a drain of the fourth PMOS transistor MP4. The third NMOS transistor MN3 may be turned off when the fourth PMOS transistor MP4 is turned on, such that the drain voltage of the third NMOS transistor MN3 is charged to, for example, about 3.3 V or some other voltage value.

The second NMOS transistor MN2 and the third NMOS transistor MN3 may be turned off by the sleep mode signal pwdb (for example, by going LOW) and a bandgap output of about 0V. Therefore, during the sleep mode, the total current consumption in the bandgap reference voltage generating circuit may be about 0 uA.

A source of the fourth NMOS transistor MN4 may be connected in parallel to the drain of the third PMOS transistor MP3 while the gate and drain of the fourth PMOS transistor MP4 may be connected to the lower limit power supply voltage AVSS3.

A source of the fifth NMOS transistor MN5 may be connected to the lower limit power supply voltage AVSS3 and its drain may be connected to the output terminal. When the bandgap reference voltage generating circuit is in the sleep mode, the fifth NMOS transistor MN5 sets the bandgap output voltage to about 0 V to suppress unnecessary power consumption in the reference voltage or reference current generating circuit which receives the bandgap output voltage.

As shown in FIG. 3, the third PMOS transistor MP3, the fourth PMOS transistor MP4, the fifth PMOS transistor MP5, the sixth PMOS transistor MP6, the first NMOS transistor MN1, the second NMOS transistor MN2, the third NMOS transistor MN3, the fourth NMOS transistor MN4, and the fifth NMOS transistor MN5 may be collectively referred to as a start-up circuit 300.

The operation of the bandgap reference voltage generating circuit according embodiments is described below with reference to the above-described configuration. In this description, example signal polarities (e.g., HIGH/LOW) are provided merely as an example. One of ordinary skill will recognize that different polarities may be used with appropriate substitution of various components.

First, in the sleep mode (e.g, when pwd=HIGH), when the second PMOS transistor MP2 is turned on, the output of the operational amplifier 30 may be charged to the first set value (for example, about 3.3 V). As a result, the first PMOS transistor MP1 is turned off and cuts off a current flowing through the first PMOS transistor MP1. The second NMOS transistor MN2 and the third NMOS transistor MN3 may also be turned off by the sleep mode signal pwdb (e.g., when pwdb=LOW) and a bandgap output voltage of about 0 V. Therefore, in the sleep mode, the total current consumption in the bandgap reference voltage generating circuit is about 0 uA.

If the bandgap reference voltage generating circuit is switched over from the sleep mode to the operation mode, the fourth PMOS transistor MP4 is turned on and the third NMOS transistor MN3 is turned off. Accordingly, the drain voltage of the third NMOS transistor MN3 is charged to the first set value (for example, about 3.3 V). Then, the first NMOS transistor MN1 and the second NMOS transistor MN2 may be turned on by the sleep mode signal pwdb (e.g., when pwdb=HIGH). As a result, the output of the operational amplifier 30 is discharged from the first set value (for example, about 3.3 V) to the second set value (for example, about 2.1 V) as an operation point.

This operation continues until the output of the bandgap reference voltage generating circuit reaches a third set value, for example, about 1.2 V. At this time, the third set value is a voltage at which the bandgap reference voltage generating circuit is in a stable state. If the output of the bandgap reference voltage generating circuit becomes the third set value (for example, about 1.2 V), the third NMOS transistor MN3 is turned on, and accordingly the drain voltage of the third NMOS transistor MN3 becomes about 0 V. Then, the first NMOS transistor MN1 is turned off, and the start-up circuit of the bandgap reference voltage generating circuit may finish its operation.

Example FIG. 4 is a graph illustrating an output voltage characteristic of the bandgap reference voltage generating circuit according to embodiments. From example FIG. 4, it can be seen that, even if the process mismatch between the input terminals of the operational amplifier is 0% (0 mV), 0.11% (1.1 mV), and 1% (10 mV), the output voltage may have a fixed voltage such as, for example, about 1.15 V when the sleep mode is switched over to the operation mode, and a substantially constant voltage is maintained.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bandgap reference voltage generating circuit comprising:

at least two bipolar transistors whose collectors are connected to a lower limit power supply voltage and are configured to generate a reference voltage by using a difference in emitter-base voltage;

an operational amplifier configured to output a substantially constant voltage according to the reference voltage and an inverted reference voltage from the at least two bipolar transistors;

a first PMOS transistor whose source is connected to an upper limit power supply voltage and is configured to supply a reference current to the at least two bipolar transistors;

a second PMOS transistor whose source is connected to the upper limit power supply voltage and is configured to supply the reference current to the at least two bipolar transistors, the second PMOS transistor configured to turn on when the bandgap reference voltage generating circuit is in a sleep mode, such that the output of the operational amplifier is charged to a first set value and the first PMOS transistor is turned off;

a third PMOS transistor whose source is connected to the upper limit power supply voltage;

a fourth PMOS transistor whose source is connected to the upper limit power supply voltage and whose gate is connected to a drain of the third PMOS transistor, the fourth PMOS transistor configured to turn on when the bandgap reference voltage generating circuit is switched over from the sleep mode to an operation mode;

a first NMOS transistor whose source is connected to the lower limit power supply voltage and whose drain is connected to a drain of the fourth PMOS transistor, the first NMOS transistor configured to be turned on when the fourth PMOS transistor is turned on, such that a drain voltage of the first NMOS transistor is charged to the first set value; and a second NMOS transistor whose drain is connected to the operational amplifier and whose gate is connected to the drain of the first NMOS transistor, the second NMOS transistor configured to be turned on when the drain voltage of the first NMOS transistor is charged, such that the output of the operational amplifier is discharged from the first set value to a second set value.

2. The bandgap reference voltage generating circuit of claim 1, further comprising:

a third NMOS transistor whose drain is connected to a source of the second NMOS transistor and whose source is connected to the lower limit power supply voltage, the third NMOS transistor configured to be turned on by a sleep mode signal of the bandgap reference voltage generating circuit.

3. The bandgap reference voltage generating circuit of claim 2, wherein the first NMOS transistor and the third NMOS transistor are turned off by the sleep mode signal and a bandgap output voltage of 0 V.

4. The bandgap reference voltage generating circuit of claim 1, further comprising:

a fifth PMOS transistor whose source is connected to a drain of the first PMOS transistor, whose gate is connected to the lower limit power supply voltage, and whose drain is connected to an output terminal of the bandgap reference voltage generating circuit; and a sixth PMOS transistor whose source is connected to the upper limit power supply voltage, and whose gate is connected to the output terminal of the bandgap reference voltage generating circuit.

5. The bandgap reference voltage generating circuit of claim 4, wherein the fifth PMOS transistor and the sixth PMOS transistor are configured to operate as a low pass filter at the output terminal of the bandgap reference voltage generating circuit.

6. The bandgap reference voltage generating circuit of claim 4, wherein the fifth PMOS transistor and the sixth PMOS transistor are configured to remove high-frequency noise.

7. The bandgap reference voltage generating circuit of claim 1, further comprising:

a third NMOS transistor whose source is connected to the drain of the third PMOS transistor and the gate of the fourth PMOS transistor, and whose drain is connected to the lower limit power supply voltage; and a fourth NMOS transistor whose source is connected to the lower limit power supply voltage and whose drain is connected to an output terminal.

8. The bandgap reference voltage generating circuit of claim 7, wherein the fourth NMOS transistor is configured to set a bandgap output voltage when the bandgap reference voltage generating circuit is in the sleep mode.

9. The bandgap reference voltage generating circuit of claim 8, wherein the bandgap output voltage is substantially 0V.

10. The bandgap reference voltage generating circuit of claim 1, wherein the operational amplifier is configured to discharge to the second set value until an output of the bandgap reference voltage generating circuit reaches a third set value.

11. The bandgap reference voltage generating circuit of claim 10, wherein the third set value is a voltage at which the bandgap reference voltage generating circuit is in a stable state.

12. The bandgap reference voltage generating circuit of claim 10, wherein when the output of the bandgap reference voltage generating circuit reaches the third set value, the first NMOS transistor is configured to turn on.

13. The bandgap reference voltage generating circuit of claim 10, wherein when the output of the bandgap reference voltage generating circuit reaches the third set value, the drain voltage of the first NMOS transistor is set to substantially 0 V.

14. A bandgap reference voltage generating circuit, comprising:

an operational amplifier having a plurality of input transistors and configured to output a constant voltage;

a startup circuit coupled with the operational amplifier and configured to switch between a sleep mode and an operation mode;

wherein: when the plurality of input transistors have a process mismatch of a predetermined value greater than zero, the operational amplifier is configured to have a stable operation point when the startup circuit switches from sleep mode to operation mode, wherein the operational amplifier is configured to operate at one of three set values.

15. The bandgap reference voltage generating circuit of claim 14, wherein the predetermined value is approximately 0.11%.

16. The bandgap reference voltage generating circuit of claim 14, wherein the predetermined value is greater than approximately 0.11%.

17. The bandgap reference voltage generating circuit of claim 16, wherein the predetermined value is approximately 1%.

18. The bandgap reference voltage generating circuit of claim 14, wherein the stable operation point comprises maintaining a constant output voltage.

19. The bandgap reference voltage generating circuit of claim 14, wherein the three set values comprise about 3.3V, about 2.1V, and about 1.15V.

* * * * *